United States Patent [19]

Adams

[11] 4,338,207

[45] Jul. 6, 1982

[54] ADDITIVE COMPOSITION FOR TURBINE OIL

[75] Inventor: J. Howard Adams, San Rafael, Calif.

[73] Assignee: Chevron Research Company, San Francisco, Calif.

[21] Appl. No.: 235,256

[22] Filed: Feb. 17, 1981

Related U.S. Application Data

[63] Continuation-in-part of Ser. No. 70,574, Aug. 29, 1979, abandoned.

[51] Int. Cl.[3] ..... C10M 1/26; C10M 1/34; C10M 1/42

[52] U.S. Cl. ..... 252/47.5; 252/42.7; 252/48.2; 252/50; 252/401

[58] Field of Search ..... 252/42.7, 47.5, 50, 252/401, 406

[56] References Cited

U.S. PATENT DOCUMENTS 3,278,602 10/1966 Peeler ..... 252/50 X 3,778,370 12/1973 Kennedy et al. ..... 252/48.2 X

*Primary Examiner*—W. J. Shine

*Attorney, Agent, or Firm*—D. A. Newell; J. M. Whitney; V. J. Cavalieri

[57] ABSTRACT

A lubricating oil additive combination especially useful for turbine oils contains 0.05 to 1.0 parts of diisobornyldiphenylamine and 0.05 to 1.0 parts of certain dithiobenzoates.

3 Claims, No Drawings

ADDITIVE COMPOSITION FOR TURBINE OIL

RELATED APPLICATIONS

This a continuation-in-part of application U.S. Ser. No. 70,574, filed Aug. 29, 1979, now abandoned.

FIELD OF THE INVENTION

This invention relates to a combination of additives useful as lubricating oil additives.

DESCRIPTION OF THE PRIOR ART

U.S. Pat. No. 3,778,370 teaches esters of dithiobenzoic acids including compositions such as benzyl (4-hydroxy-3,5-di-t-butyl)-dithiobenzoate. U.S. Pat. No. 3,278,602 teaches mono and dibornyldiphenylamines. The disclosures of each is hereby incorporated by reference.

SUMMARY OF THE INVENTION

It is has now been found that a mixture of 0.05 to 1.0 parts diisobornyldiphenylamine and 0.05 to 1.0 parts of dithiobenzoate of the formula

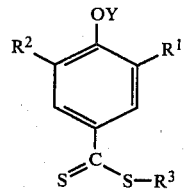

wherein Y is hydrogen or an alkali or alkaline earth metal cation, $R^1$ and $R^2$ are independently $C_{4-9}$ branched-chain alkyl and $R^3$ is $C_{1-20}$ alkyl, $C_{6-20}$ aryl or $C_{7-20}$ aralkyl, gives outstanding antioxidant control as measured by the turbine oil stability test (ASTM Standard Method D-943).

DESCRIPTION OF THE INVENTION

Diisobornyldiphenylamine is prepared from alphapinene and diphenyl amine by methods well-known in the art. It is a known antioxidant in turbine oil.

The dithiobenzoates disclosed herein are also known antioxidants. Preferred dithiobenzoates of the above formula are those wherein $R^3$ is phenyl, benzyl or p-xylyl, preferably benzyl, and wherein y is hydrogen, sodium or potassium, most preferably hydrogen. The $R^1$ and $R^2$ groups are preferred to be tertiarybutyl.

The stability of certain turbine oil formulations was determined according to ASTM Standard Method D-943. Using this method, the oxidation stability is measured in terms of hours until a neutralization number of 2.0 is reached. The acid number was found according to ASTM Standard Method D-974. The table below indicates test results for a variety of compositions. Each contained an identical amount of rust and foam inhibitor. As can be seen, the antioxidant control provided by the compositions of this invention far exceed that which would be expected from reviewing the oxidation control of each component separately.

TURBINE OIL STABILITY TESTS IN MID CONTINENT SOLVENT REFINED BASE OIL ISO 32 GRADE

| Components in formulation weight % | I | II | III | IV | V | VI | VII |
|---|---|---|---|---|---|---|---|
| dibutyl p-cresol | 1.0 | | | | | | |
| 4,4'-methylenebis (2,6-di-t-butylphenol) | | | | | | 0.25 | |
| diisobornyldiphenylamine* | 0.075 | 0.075 | | 0.075 | | 0.075 | 0.075 |
| benzyl(4-hydroxy-3,5-di-t-butyl) dithiobenzoate | | 0.5 | 0.5 | 0.25 | 0.25 | | |
| Hours to 2.0 neutralization number | 2700 | 3070 | 2300 | 2600 | 1300 | 1400 | 168 |

*Added as a 0.15% by weight of an oil solution containing 50% by weight of diisorbornyldiphenylamine Ordinarily, the total antioxidant additive composition of this invention is present as from 0.01 to 5.0 percent by weight, preferably 0.2 to 1.0 percent by weight of the finished lubricating oil composition. To save storage, the additive composition is often first formulated as a concentrate of 5 to 80 percent, preferably 30 to 50 percent in oil. The concentrate is then diluted prior to use with an additional amount of lubricating oil to form the finished oil.

The lubricating oil can be a mineral lubricating oil of either paraffinic or naphthenic types. Synthetic lubricating oils may also be used, including alkylene oxide polymers such as the 2-ethyl-hexanol-initiated polymer of propylene oxide and/or ethylene oxide. Esters of carboxylic acids, such as di-(2-ethylhexyl)sebacate are also suitable. Silicate esters, such as tetraoctyl silicate, hexa-(2-ethylbutoxy)disiloxane and mixtures thereof may be used. If desired, the lubricating oil can be a mixture of mineral oils and/or synthetic oils.

The additive combination of this invention is also useful in lubricant compositions in combination with other additives such as pour point depressants, oiliness and extreme pressure agents, detergents, viscosity index improvers, as well as other conventional additives.

What is claimed is:

1. A lubricating oil additive composition containing 0.05 to 1 parts diisobornyldiphenylamine and 0.05 to 1 parts of benzyl (4-hydroxy-3,5-di-t-butyl)dithiobenzoate.

2. A lubricating oil composition comprising an oil of lubricating viscosity and from 0.2 to 1% by weight of the composition according to claim 1.

3. A lubricating oil concentrate composition comprising an oil of lubricating viscosity and from 5 to 80% by weight of the composition according to claim 1.

* * * * *